US008807505B2

(12) United States Patent
Lotz, III

(10) Patent No.: US 8,807,505 B2
(45) Date of Patent: Aug. 19, 2014

(54) ACCESSORY HOLDER SYSTEM AND RELATED METHOD

(76) Inventor: Martin W. Lotz, III, Stevenson, MD (US)

( * ) Notice: Subject to any disclaimer, the term of this patent is extended or adjusted under 35 U.S.C. 154(b) by 7 days.

(21) Appl. No.: 13/471,553

(22) Filed: May 15, 2012

(65) Prior Publication Data

US 2013/0306821 A1 Nov. 21, 2013

(51) Int. Cl.

| | |
|---|---|
| ***A47B 91/00*** | (2006.01) |
| ***A47G 29/00*** | (2006.01) |
| ***B65D 19/00*** | (2006.01) |

(52) U.S. Cl.

USPC ..... 248/346.03; 248/309.1; 248/310; 248/316.3; 248/500; 224/676; 224/674; 224/251; 224/250

(58) Field of Classification Search

USPC ..... 248/346.01, 309.1, 310, 346.03, 500
See application file for complete search history.

(56) References Cited

U.S. PATENT DOCUMENTS

| | | | | |
|---|---|---|---|---|
| 468,858 | A * | 2/1892 | Barber | 24/265 BC |
| 1,392,461 | A * | 10/1921 | Struebing | 297/423.1 |
| 2,706,041 | A * | 4/1955 | Tate | 206/348 |
| 3,858,719 | A * | 1/1975 | Isaacs | 206/49 |
| 4,814,806 | A | 3/1989 | Flax | |
| 4,889,230 | A * | 12/1989 | Zachry | 206/362 |
| 5,370,288 | A * | 12/1994 | Field | 224/223 |
| 5,410,762 | A | 5/1995 | Maskovich | |
| 5,706,862 | A * | 1/1998 | Meinerding, Sr. | 138/99 |
| 6,186,737 | B1 * | 2/2001 | Cohen | 414/800 |
| 6,581,891 | B1 * | 6/2003 | Byrd | 248/219.4 |
| 8,499,990 | B2 * | 8/2013 | Smith | 224/676 |
| 2005/0087665 | A1 * | 4/2005 | Sutherland et al. | 248/346.01 |
| 2007/0090254 | A1 * | 4/2007 | Del Frari | 248/309.1 |
| 2010/0072215 | A1 * | 3/2010 | Coon | 220/735 |
| 2011/0170854 | A1 | 7/2011 | Tse, Jr. | |

FOREIGN PATENT DOCUMENTS

WO WO 2010080151 A1 * 7/2010

OTHER PUBLICATIONS

Adorama (http://web.archive.org/web/20040323191127/http://www.adorama.com/BG3152.html).*

* cited by examiner

*Primary Examiner* — Bradley Duckworth
*Assistant Examiner* — Asha Puttaiah
(74) *Attorney, Agent, or Firm* — Law Office of Ilya Libenzon

(57) ABSTRACT

An accessory holder system and related method are disclosed. The invention features an accessory holder system for holding accessory items comprising at least one base plate comprising a top portion, a bottom portion, and a sidewall portion, a rubber band secured to the at least one base plate adapted to removably hold at least one accessory item inserted between the base plate and the rubber band, and attaching means for attaching the base plate to an object.

3 Claims, 6 Drawing Sheets

ACCESSORY HOLDER SYSTEM AND RELATED METHOD

TECHNICAL FIELD

The invention relates to holder systems and related methods. More specifically, the invention relates to accessory holder systems for holding accessory items and related methods.

BACKGROUND

Often, people use various accessories that need to be temporarily held in a secured and simple manner to prevent such accessories from being damaged or lost by mishandling. For example, some accessories, such as camera lens caps, may be secured to a camera lens for protecting the lens. After such an accessory is removed from a camera lens, it is desirable to protect the accessory by placing it temporarily in an accessory holder. The prior art accessory holder systems, however, are bulky, expensive, and difficult to handle. Furthermore, such systems do not accommodate effectively for holding accessory items of different sizes and shapes.

SUMMARY

It is therefore an object of the present invention to provide an accessory holder system that is compact and inexpensive to fabricate.

It is further object of the present invention to provide an accessory holder system that is easy to handle.

It is yet further object of the present invention to provide an accessory holder system that accommodates effectively for holding accessory items of different sizes and shapes.

Accordingly, the invention features an accessory holder system for holding accessory items comprising at least one base plate comprising a top portion, a bottom portion, and a sidewall portion, a rubber band secured to the at least one base plate adapted to removably hold at least one accessory item inserted between the base plate and the rubber band, and attaching means for attaching the base plate to an object.

In one embodiment of the present invention, the attaching means is disposed on the bottom portion of the at least one base plate.

According to another embodiment of the present invention, the rubber band is permanently secured to the at least one base plate.

In one instance, the rubber band is detachably secured to the at least one base plate.

In another instance, the system further comprises at least two diametrically opposite recesses formed in the sidewall portion of the at least one base plate for receiving the rubber band and preventing the rubber band from sliding off of the base plate.

In some embodiments of the present invention, the rubber band is secured to the at least one base plate by being stretched around the at least one base plate.

In some preferred variants of the present invention, the at least one base plate further comprising two diagonally opposite tab portions formed by two diagonally opposite slots extending from opposite edges of the base plate perpendicularly to a horizontal central line of the base plate.

In some instances, the rubber band is secured to the at least one base plate by being inserted into the slots, wrapped around the tab portions and stretched over the top portion of the at least one base plate such that the bottom portion of the at least one base plate is covered by the rubber band only at the tab portions.

In some embodiments, the attaching means comprising at least one opening in the at least one base plate for attaching the base plate to an object.

According to some variants of the present invention, the system comprises at least two base plates.

In one instance, the at least two base plates are attached together using attaching means in a side-by-side configuration, back-to-back configuration, crisscross configuration, or combination thereof.

In another instance, the at least two base plates are permanently attached together.

According to some embodiments, the at least two base plates are detachably attached together.

A method of removably holding accessory items using the system described above is also disclosed. The method comprises the step of inserting at least one accessory item between the rubber band and the at least one base plate.

The method of assembling the system described above is also disclosed. The method comprises the steps of providing at least one base plate, securing a rubber band to the at least one base plate, and attaching the base plate to an object using attaching means.

According to some variants of the method of assembling the system, the step of securing the rubber band to the at least one base plate is performed by stretching the rubber band around the at least one base plate.

In some instances, the step of securing the rubber band to the at least one base plate is performed by sliding the rubber band into the slots, wrapping the rubber band around the tab portions, and stretching the rubber band over the top portion of the at least one base plate such that the bottom portion of the at least one base plate is covered by the rubber band only at the tab portions.

In some instances, the securing the rubber band to the at least one base plate comprises permanently securing the rubber band to the at least one base plate.

In other instances, the securing the rubber band to the at least one base plate comprises releasably securing the rubber band to the at least one base plate.

And yet in some other instances, the method further comprises the step of attaching another base plate to the at least one base plate.

Other aspects, embodiments and features of the invention will become apparent from the following detailed description of the invention when considered in conjunction with the accompanying figures. The accompanying figures are for schematic purposes and are not intended to be drawn to scale. In the figures, each identical or substantially similar component that is illustrated in various figures is represented by a single numeral or notation. For purposes of clarity, not every component is labeled in every figure. Nor is every component of each embodiment of the invention shown where illustration is not necessary to allow those of ordinary skill in the art to understand the invention.

DESCRIPTION OF DRAWINGS

The preceding summary, as well as the following detailed description of the invention, will be better understood when read in conjunction with the attached drawings. For the purpose of illustrating the invention, presently preferred embodiments are shown in the drawings. It should be understood, however, that the invention is not limited to the precise arrangements and instrumentalities shown.

DETAILED DESCRIPTION

Figure 1:
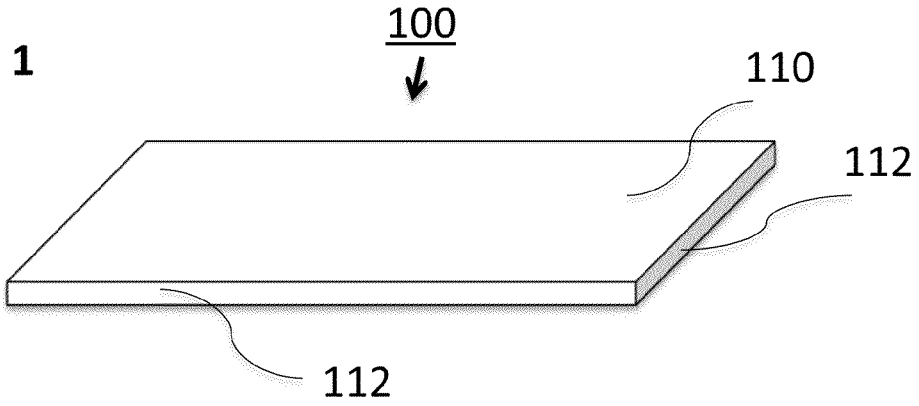
FIG. 1 shows the components of an accessory holder system of the present invention.
Figure 1:
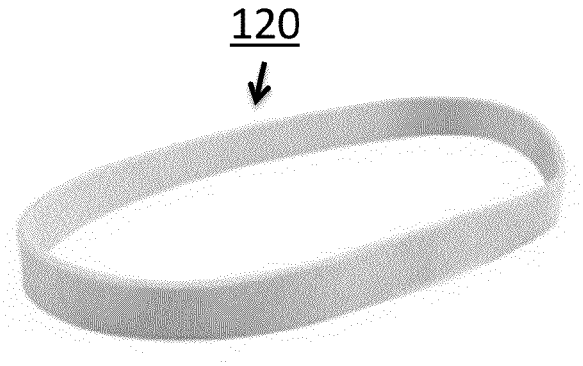
Figure 2A:
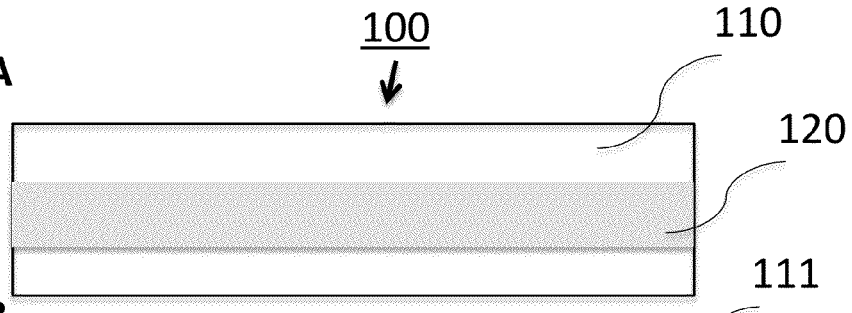
FIG. 2A is a top view of the system in accordance with one variant of the present invention, showing a top portion of a base plate.
Figure 2B:
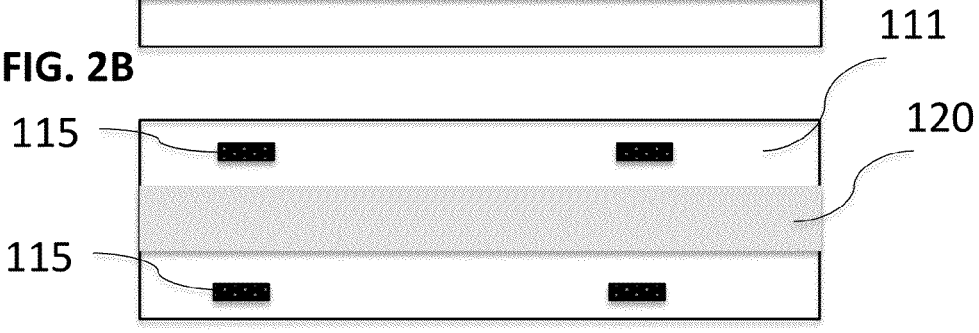
FIG. 2B is a top view of the system in accordance with the variant of the present invention illustrated in FIG. 2A, showing a bottom portion of the base plate.
Figure 3A:
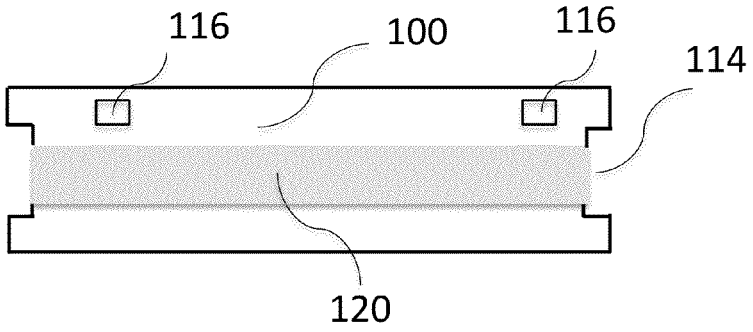
FIG. 3A is a top view of the system in accordance with the preferred embodiment of the present invention illustrated in FIG. 2C, showing attaching means for attaching the base plate to an object.
Figure 3B:
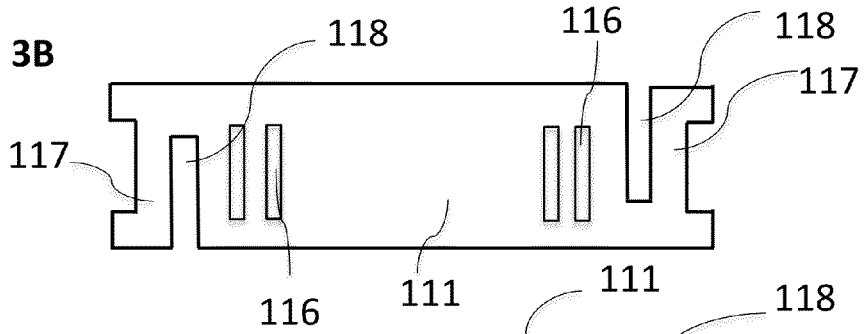
FIG. 3B is a top view of the system in accordance with another preferred embodiment of the present invention, showing a bottom portion of the base plate and attaching means for attaching the base plate to an object.
Figure 3C:
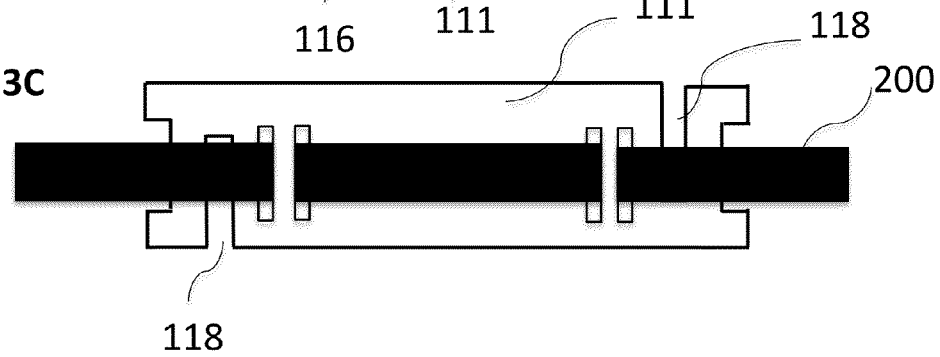
FIG. 3C is a top view of the system in accordance with the preferred embodiment of the present invention illustrated in FIG. 3B, illustrating the attachment of the base plate to an object using the attachment means.
Figure 5:
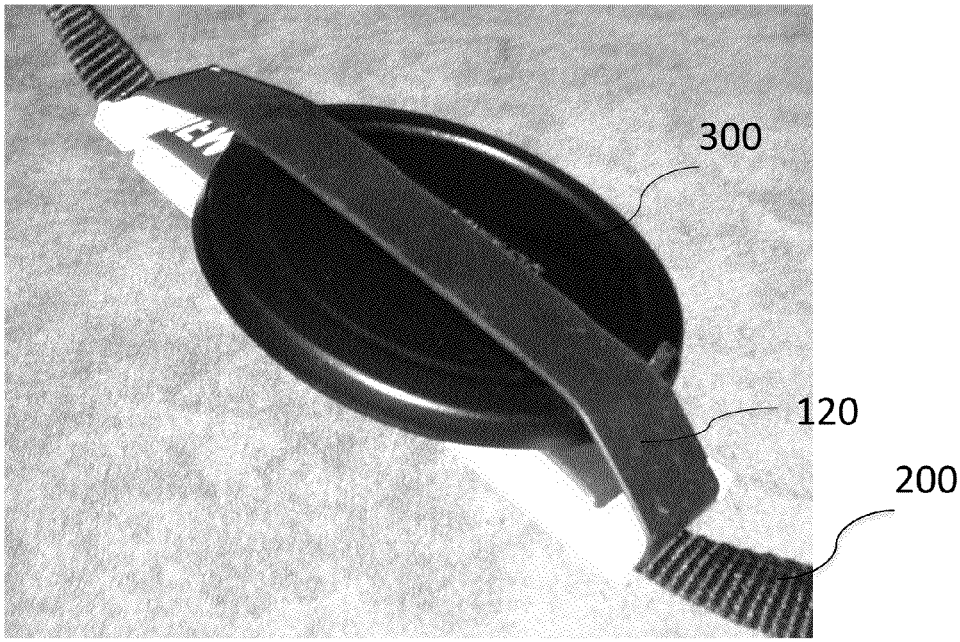
FIG. 5 illustrates a method of using the system in accordance with the present invention.

The present invention features an accessory holder system for holding accessory items comprising at least one base plate (100) as shown in FIG. 1, which comprises a top portion (110), a bottom portion (not shown), and a sidewall portion (112); a rubber band (120) secured to said at least one base plate (100) adapted to removably hold at least one accessory item (such as lens cap 300 shown in FIG. 5) inserted between said base plate (100) and said rubber band (120); and attaching means (115, FIG. 2B) for attaching said base plate to an object (such as strap 200 shown in FIG. 3C and FIG. 5).

According to some embodiments of the present invention, the attaching means (115) can be disposed on the bottom portion (111) of the base plate (100) as shown in FIG. 2B.

The attaching means such as magnets, Velcro brand hooks, loop fasteners, suction cups, or the like can be used to detachably attach base plate 100 to an object of interest, such as a refrigerator, a desk, a camera strap, a belt, or the like. The attaching means such as adhesives, glue, double sided adhesives, screws, nails, or the like can be used to permanently secure base plate 100 to an object of interest.

As shown in FIGS. 2A and 2B, rubber band 120 is secured to base plate 100 by being stretched around the base plate along the top portion 110 and bottom portion 111 of base plate 100, and sidewall portion 112 (not shown). In some instances, after being stretched around the base plate, rubber band 120 can be permanently secured to the base plate using glue, adhesives, or other suitable materials.

According to the present invention, the rubber band can be made of any suitable rubber materials, silicone, latex, combination thereof, or any other commercially available elastic materials suitable for practicing the present invention. The rubber band has to be stretchable, elastic and be able to removably hold an accessory item or items when inserted between the rubber band and the base plate. The rubber band can have any suitable color. In some instances, the color of the rubber band can match the color of an accessory item to be held. For example, a red rubber band can be used to hold a red lens cap and so forth. In some instances, the color of the rubber band can be different from that of an accessory item (or items) to be held.

The base plate can be made of plastic, metal, steel, alloys, wood, combination thereof, or any other suitable materials. The top and bottom portion of the base plate can be rectangular, square, oval, circular, or of any other shape. In some instances, the shape of the base plate can match the shape of accessory items to be held. For example, to hold a circular lens cap of a photo camera, the base holder can be made circular in shape.

Figure 2C:
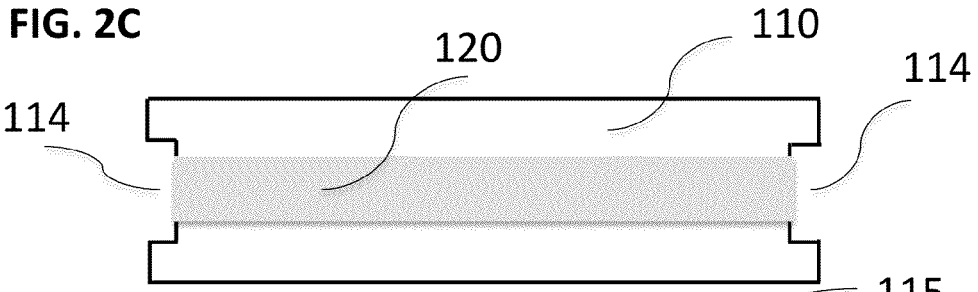
FIG. 2C is a top view of the system in accordance with another preferred embodiment of the present invention, showing a top portion of a base plate.
Figure 2D:
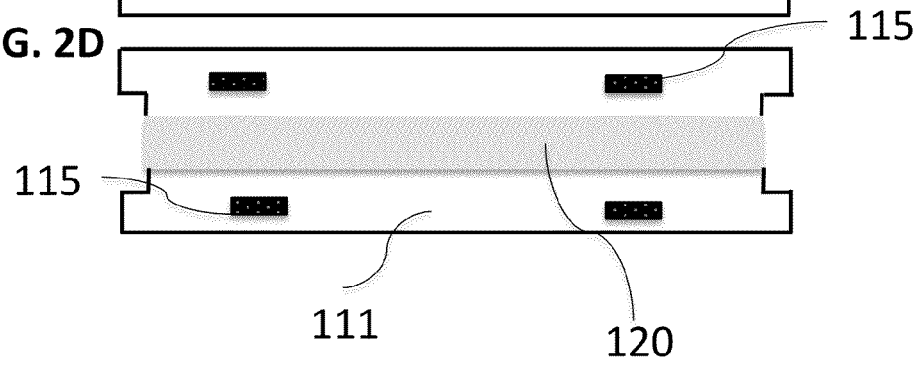
FIG. 2D is a top view of the system in accordance with the preferred embodiment of the present invention illustrated in FIG. 2C, showing a bottom portion of the base plate.

In some instances, when the rubber band is detachably secured to the base plate, the system further comprises at least two diametrically opposite recesses 114 (as shown in FIG. 2C) formed in sidewall portion 112 (FIG. 1) for receiving the rubber band 120 and preventing the rubber band from sliding off of the base plate 100.

According to some embodiments of the present invention, the attaching means for attaching the base plate to an object can be at least one opening formed in the base plate, for example, two openings 115 formed in the base plate 100 as illustrated in FIG. 3A. The opening (or openings) 115 can be used to attach the base plate to an object of interest by receiving nails, screws, hooks, or any other suitable for this purpose articles.

The base plate can be attached permanently to an object of interest, for example by inserting the screws through the holes and permanently tightening the screws until the base plate is secured to an object of interest. Alternatively, the base plate can be removably secured to an object of interest. For example, the base plate can be attached to a wall by hanging the base plate on the hooks in the wall, or by releasably engaging the spring-loaded clips, or by other suitable attaching means.

Figure 4A:
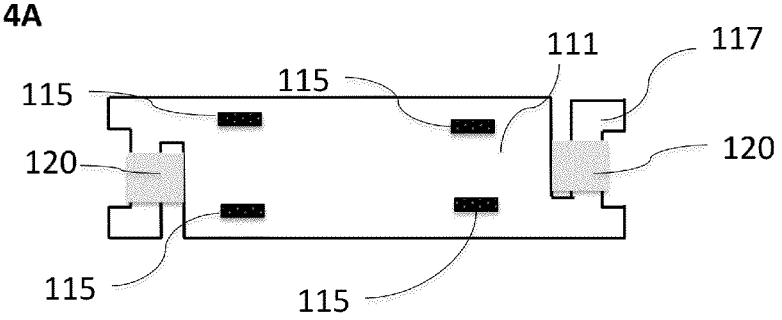
FIG. 4A is a top view of the system in accordance with another preferred embodiment of the present invention, showing a bottom portion of the base plate with a rubber band covering tab portions, and attaching means for attaching the base plate to an object.
Figure 4B:
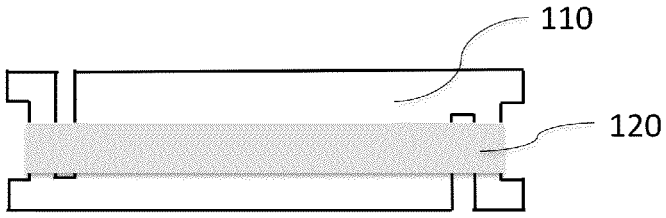
FIG. 4B is a top view of the system in accordance with the preferred embodiment of the present invention illustrated in FIG. 4A, showing a top portion of the base plate and the rubber band stretched over the top portion.

According to some embodiments of the present invention the base plate 100 can further comprise two diagonally opposite tab portions 117 formed by two diagonally opposite slots 118 extending from opposite edges of said base plate 100 perpendicularly to a horizontal central line of the base plate 100 as shown in FIG. 3B. The rubber band 120 is secured to the base plate 100 by being inserted into the slots 118 thereby being wrapped around the tab portions 117, and stretched over the length of the top portion 110 (FIG. 4B) of the base plate 100 such that the bottom portion 111 of the base plate 100 is covered by the rubber band 120 only at said tab portions 117 as shown in FIG. 4A.

Figure 3D:
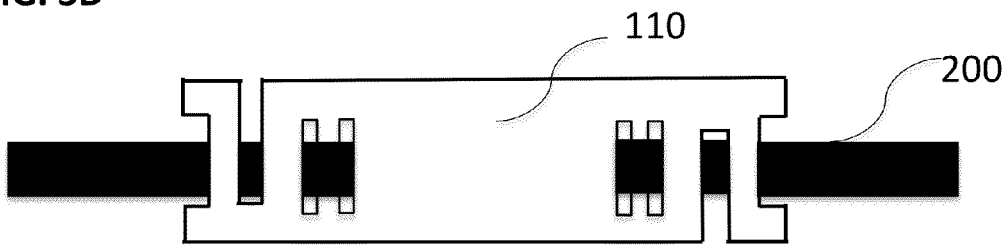
FIG. 3D is a top view of the system in accordance with the preferred embodiment of the present invention illustrated in FIG. 3C, showing a top portion of the base plate.

According to the present invention, the attaching means for attaching the base plate to an object of interest can comprise four openings 116 as shown in FIG. 3B for receiving an object of interest (200) such as a belt, or a strap, or any other strip of material to be inserted into the openings as shown in FIGS. 3C and 3D, which results in the object 200 extending along the length of the bottom portion 111 of the base plate as shown in FIG. 3C and the top portion 110 of the base plate being substantially devoid of the object 200 as shown in FIG. 3D.

Figure 4C:
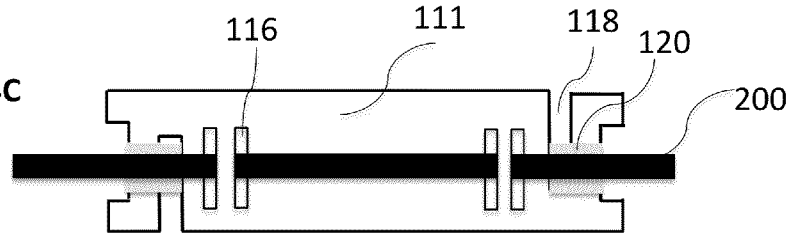
FIG. 4C is a top view of the system in accordance with another preferred embodiment of the present invention, showing a bottom portion of the base plate with a rubber band covering tab portions, attaching means for attaching the base plate to an object, and the object.
Figure 4D:
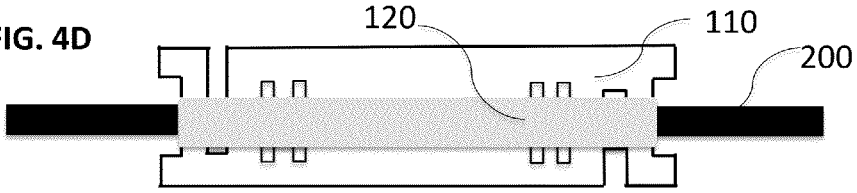
FIG. 4D is a top view of the system in accordance with the preferred embodiment of the present invention illustrated in FIG. 4C, showing a top portion of the base plate with the rubber band stretched over the top portion.

FIGS. 4C and 4D illustrate a preferred embodiment of the present invention wherein the base plate is detachably secured to an object of interest (200) such as a belt, strap, or a strip of material by inserting the object 200 into openings 116 and then rubber band 120 is removably secured to the base plate with the proximal ends of the rubber band being inserted into slots 118 such that the rubber band wraps around the tap portions 117 stretches over the length of the top portion 110 as shown in FIG. 4D. An accessory item (such as a camera lens cap, for example) can be removably held by inserting the item into rubber band 120 as illustrated in FIG. 5. The accessory item can also be removably held by inserting it between the base holder and the rubber band (not shown).

Figure 6A:
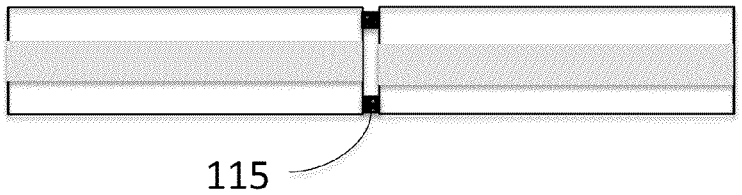
FIGS. 6A, 6B, and 6C show a system having two base plates attached together in the side-by-side configuration according to embodiments of the present invention.
Figure 6B:
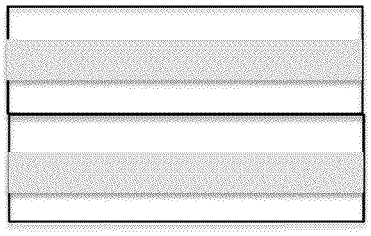
Figure 6C:
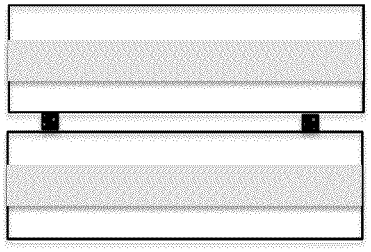

According to another preferred embodiment, the system can include another base plate or plates with a rubber band secured to each plate. As shown in FIGS. 6A, 6B, and 6C, the base plates can be attached in a side-by-side configuration. The base plates can be permanently attached to each other using attaching means 115 such as adhesives, glues, or the like materials.

Figure 6D:
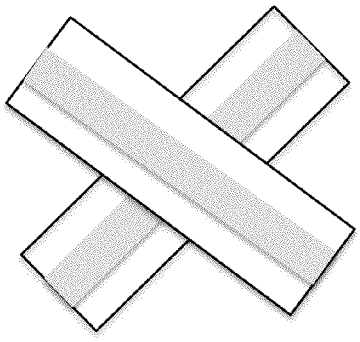
FIG. 6D illustrates a system having two base plates attached together in the crisscross configuration in accordance with one embodiment of the present invention.
Figure 6E:
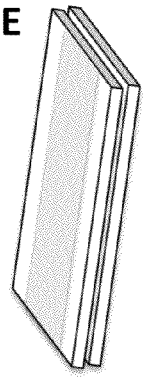
FIG. 6E illustrates a system having two base plates attached together in the back-to-back configuration in accordance with one embodiment of the present invention.
Figure 6F:
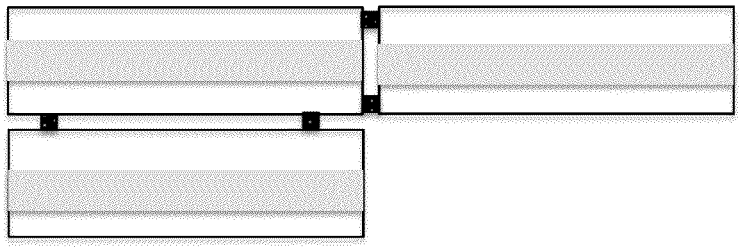
FIG. 6F illustrates a system having three base plates attached together in the side-by-side configuration.

The base plates also can be detachably secured to each other using Velcro type fasteners, or magnets, or other suitable attaching means. For example, a set of corresponding protrusions and recesses can be made in the corresponding sidewall portions of the base plate for inserting protrusions into recesses and thereby detachably securing the base plates to each other. The plates can be also attached in a crisscross configuration such as shown in FIG. 6D, or in a back-to-back configuration as illustrated in FIG. 6E. Multiple plates can be attached together as shown in FIG. 6F. The plates can be attached in a combination of different configurations. For example, two plates can be attached together in a side-by-side configuration and another plate can be attached to one of the two plates using a back-to-back configuration, and so forth.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An accessory holder system for holding accessory items comprising:

a base plate comprising a top portion, a bottom portion, two ends, and two sides;

two tab portions located opposite each other on the two ends, each tab portion combining with the end of said base plate on which the tab portion is located to form a slot having an opening on one side of the base plate, with the openings of the two slots located on opposite sides of the base plate, and each tab further comprising a notch facing away from the base plate;

attaching means comprising four slot-shaped openings arranged in pairs;

at least one strap, secured to the base plate by threading the at least one strap through the four slot-shaped openings; and a rubber band secured to said base plate by slipping the band over each notch and through each of the two slots, and adapted to removably hold at least one accessory item inserted between said base plate and said rubber band.

2. The system of claim 1, wherein said rubber band is detachably secured to said at least one base plate.

3. The system of claim 1, wherein said rubber band is secured to said base plate by being inserted into said slots and wrapped around said tab portions, and stretched over said top portion of said base plate such that the bottom portion of said base plate is covered by the rubber band only at said tab portions.

* * * * *